US005700584A

United States Patent [19]

Suematsu

[11] Patent Number: 5,700,584

[45] Date of Patent: Dec. 23, 1997

[54] THERMAL TRANSFER RECORDING MEDIUM

[75] Inventor: Hideki Suematsu, Osaka, Japan

[73] Assignee: Fujicopian Co., Ltd., Japan

[21] Appl. No.: 410,045

[22] Filed: Mar. 24, 1995

[30] Foreign Application Priority Data

Mar. 25, 1994 [JP] Japan ..... 6-056244

[51] Int. Cl.[6] ..... B41M 5/26; B41M 5/34; B41M 5/40

[52] U.S. Cl. ..... 428/484; 428/195; 428/488.1; 428/488.4; 428/913; 428/914

[58] Field of Search ..... 8/471; 428/195, 428/484, 488.1, 488.4, 913, 914; 503/227

[56] References Cited

U.S. PATENT DOCUMENTS 4,732,815 3/1988 Mizobuchi et al. ..... 428/484

FOREIGN PATENT DOCUMENTS

A-0333873 9/1989 European Pat. Off. ..... 503/227
A-0474355 3/1992 European Pat. Off. ..... 503/227
A-0 547 233 6/1993 European Pat. Off. ..... 503/227
A-62-48591 3/1986 Japan ..... 503/227
A-61-51387 3/1987 Japan ..... 503/227
A-5-8566 1/1993 Japan ..... 503/227

OTHER PUBLICATIONS

English-language translation-in-part for Japanese publication 61-51387.
English-language translation-in-part for Japanese publication 62-48591.

*Primary Examiner*—Bruce H. Hess
*Attorney, Agent, or Firm*—Fish & Neave

[57] ABSTRACT

A thermal transfer recording medium comprising a foundation, and a filling ink layer provided on the foundation, the filling ink layer being thermally transferred onto a receptor in advance of formation of a print image thereon, the filling ink layer comprising a release layer, a transfer layer having a high melt viscosity and an adhesive layer which three layers are stacked in this order on the foundation, with use of the recording medium, the surface of a receptor paper that is significantly uneven can be changed to a flat one by a single thermal transfer operation, and print images of high quality can be formed by transferring a colored ink layer onto the flat surface.

7 Claims, 2 Drawing Sheets

THERMAL TRANSFER RECORDING MEDIUM

BACKGROUND OF THE INVENTION

The present invention relates to thermal transfer recording media for use in a variety of print image forming apparatuses utilizing a dot type thermal transfer recording system, such as a thermal printer, a thermal copying machine and a thermal facsimile terminal equipment.

Heretofore, according to the dot type thermal transfer recording system using a thermal transfer recording medium, some times, a colored ink layer was not transferred in a perfect dot form due to the uneven surface of a receptor paper which causes ink dots with defects such as chips or dropout portions, or dropout of ink dots, thus contributing to deterioration of quality of the resulting print image.

The following two ways were adopted for the purpose of solving the above problem to improve the quality of transferred ink dots: (1) One way is to increase the thickness of a colored ink layer of the thermal transfer recording medium. (2) The other way is that wherein before thermal transfer of a colored ink layer, a filling ink layer is thermally transferred to fill in depressed portions of a receptor paper, thereby smoothing the surface of the receptor paper, and then a colored ink is transferred thereon (Japanese Unexamined Patent Publication No. 95194/1984).

However, the above way (1) involves a problem that the light transmittance of the ink layer is too low due to its increased thickness, and, for example, an image wherein different color ink dots are superimposed one over the other to develop a color by virtue of subtractive color mixture has a low color saturation or purity.

The above way (2) involves a problem that when the unevenness of the receptor paper is not significant, small depressed portions thereof can be filled in with the filling ink, but when the unevenness of the receptor paper is significant, large depressed portions thereof cannot be perfectly filled in with the filling ink because the filling ink layer which can be perfectly transferred has an upper limit due to the mount of heat energy generated from heat generating elements of a thermal head and other factor.

That is, the upper limit of the coating mount of the filling ink layer provided on a thermal transfer recording medium is about 12 g/m$^2$ from the viewpoints of the mount of heat energy generated from the heat generating elements which is limited by characteristics of the thermal head, the heat-resistance of the foundation of the thermal transfer recording medium and printing speed.

Further, the conventional filling ink layer is of a single-layer type which is composed of a wax as a main component and has a low melt viscosity.

When such a filling ink layer having a low melt viscosity and a limited thickness is transferred onto a receptor paper with a significant unevenness, filling ink 20 is penetrated into the inside of receptor paper 10 and the surface of filling ink 20 transferred is contoured along the uneven surface of receptor paper 10 as shown in FIG. 5, so that the depressed portions of receptor paper 10 are not perfectly filled in with filling ink, resulting in failure to make the surface of the receptor paper 10 flat.

When a colored ink is thermally transferred onto the filling ink 20 with such a surface condition, the problem occurs that the resulting ink image contains voids.

Even if it is tried to smooth the uneven surface of a receptor paper by using a single-layer type filling ink layer with a larger coating mount, e.g. 14 g/m$^2$, the heat energy is deficient to transfer such a thick filling ink layer under usual printing energy and speed, so that the transferred filling ink layer contains voids in itself and cannot do the job.

In order to solve this problem, a further way was proposed that a filling ink layer with a small coating amount is repeatedly transferred depending upon the degree of surface unevenness of a receptor paper to fill in the depressed portions thereof (Japanese Unexamined Patent Publication No. 37471/1986). However, the way involves problems such as complexity of operation and increased costs.

It is an object of the present invention to provide a thermal transfer recording medium having a filling ink layer which is capable of making flat the surface of a receptor paper that is significantly uneven by a single thermal transfer operation.

Another object of the present invention is to provide a thermal transfer recording medium capable of forming a print image of high quality with no defects such as voids on a receptor paper having a significantly eneven surface.

These and other objects of the present invention will become apparent from the description hereinafter.

SUMMARY OF THE INVENTION

The present invention provides a thermal transfer recording medium comprising a foundation, and a filling transfer layer provided on the foundation, the filling transfer layer being thermally transferred onto a receptor in advance of formation of a print image thereon, the filling transfer layer comprising a release layer, a transfer layer comprising a resin as a main ingredient and having a high melt viscosity and an adhesive layer, which three layers are stacked in this order on the foundation.

According to an embodiment of the present invention, the thermal transfer recording medium further comprises a colored ink layer provided on the foundation in addition to the filling transfer layer (the filling transfer layer of the present invention is also referred to herein as a filling ink layer).

According to another embodiment of the present invention, the colored ink layer comprises a yellow ink layer, a magenta ink layer and a cyan ink layer.

DETAILED DESCRIPTION

Figure 1:
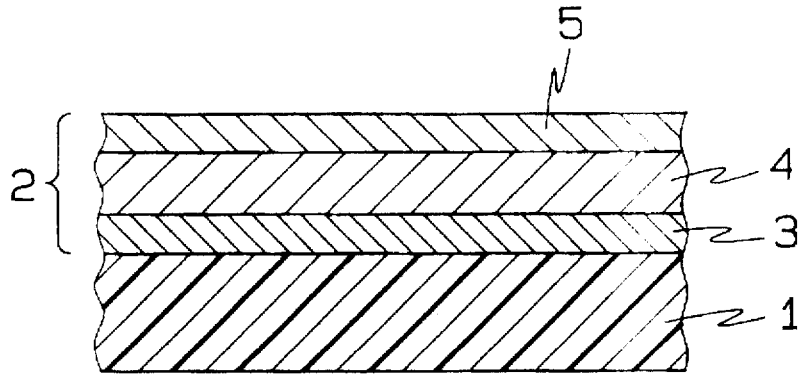
FIG. 1 is a schematic partial sectional view showing an example of the thermal transfer recording medium of the present invention.

FIG. 1 is a schematic partial sectional view showing an example of the thermal transfer recording medium of the present invention. In FIG. 1, numeral 1 denotes a foundation on which a filling ink layer 2 is provided. The filling ink layer 2 has a three-layer structure wherein a release layer 3, a transfer layer 4 having a high melt viscosity and an adhesive layer 5 are provided in this order on the foundation 1.

The release layer 3 is a layer which readily melts when thermally transferring and has a function of facilitating release of the transfer layer 4 from the foundation i. The transfer layer 4 is a layer which has a high melt viscosity and a function of imparting a bridging transfer property to the filling ink layer 2 for the purpose of making an uneven surface of a receptor paper smooth after thermally transferring. The adhesive layer 5 is a layer which readily melts when thermally transferring and has a function of transferring and fixing a heated portion of the filling ink layer to the receptor paper.

Figure 2:
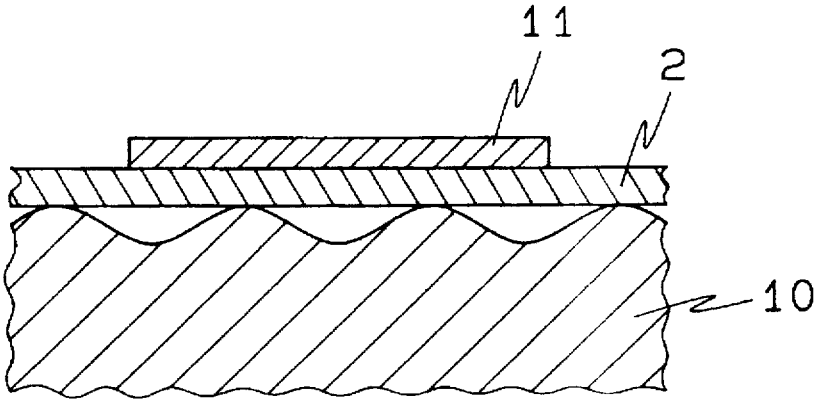
FIG. 2 is a schematic partial sectional view showing a condition where with use of the thermal transfer recording medium of the present invention, a filling ink layer is thermally transferred on a receptor paper and a colored ink layer is thermally transferred on the filling ink layer to give a print image.

FIG. 2 illustrates a condition where with use of the thermal transfer recording medium of the present invention, the filling ink layer 2 is thermally transferred on a receptor paper 10 and a colored ink layer is thermally transferred on the filling ink layer 2 to give a print image. In FIG. 2, the filling ink layer 2 is transferred as bridging over depressed portions of a receptor paper 10 with adhering not to the depressed portions but to only projecting portions thereof by virtue of the high melt viscosity of the transfer layer 4. The surface of the transferred filling ink layer 2 is flat. Dots 11 of the colored ink layer are transferred on the flat surface of the filling ink layer 2.

As described above, the filling ink layer 2 of the present invention is different from a conventional filling ink layer of the type where the depressed portions of the receptor paper are filled in with the filling ink, and has the characteristic that it is fixed to the uneven surface of the receptor paper 10 in such a bridging condition. Accordingly, the surface of the filling ink layer 2 transferred on the receptor paper 10 is flat and the dots 11 of the colored ink layer transferred on the filling ink layer 2 do not involve defects such as voids, resulting in print images with an improved quality.

The release layer 3 is a heat meltable layer composed of a wax as a major component. The release layer 3 preferably has a melting temperature of 50° to 90° C. and a melt viscosity of 5 to 100 cps at 100° C. from the viewpoint of release performance.

Examples of the wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes can be used either alone or in combination.

The release layer may contain a small amount of, for example, 5 to 20% by weight of a resin for enhancing adhesion to the foundation. Examples of the resin are thermoplastic resins (including elastomers) including ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, cellulose resins, natural rubber, styrene-butadiene copolymer, isoprene polymer and chloroprene polymer; and tackifier resins including petroleum resins, rosin resins and terpene resins. These resins can be used either alone or in combination.

The release layer 3 may be formed by use of a coating liquid in any form of hot-melt type, solvent type and emulsion type. The coating amount (on dry weight basis, hereinafter the same) of the release layer is preferably from 0.3 to 2 g/m$^2$. A release layer with a coating amount of smaller than the above range does not exhibit a sufficient release effect. A release layer with a coating amount of larger than the above range unfavorably requires a large amount of heat energy for transferring.

The transfer layer 4 is a layer having a bridging-transfer property which is composed of a resin as a major ingredient and has a high melt viscosity. The transfer layer 4 is hereinafter referred to as "bridging-transfer layer". The bridging-transfer layer preferably has a melting or softening temperature of 60° to 95° C. and a melt viscosity of 150 to 10,000 cps at 100° C. for ensuring the bridging-transfer property.

The bridging-transfer layer 4 preferably contains 40 to 80% by weight of a tackifier resin and 15 to 40% by weight of a thermoplastic resin (including elastomer) as the essential ingredients. When the content of the tackifier resin is less than the above range, the bridging transfer property is prone to be degraded. When the content of the tackifier resin is more than the above range, the melt viscosity of the bridging-transfer layer is too high, resulting in poor selective transferability. The term "selective transferability" means that only portions of the transfer layer heated are transferred with no unwanted portions being transferred. When the content of the thermoplastic resin is less than the above range, the adhesion to the release layer is prone to be poor. When the content of the thermoplastic resin is more than the above range, the adhesion to the release layer is excessively enhanced, resulting in generation of noises when the recording medium is detached from the receptor paper.

Examples of the aforesaid tackifier resin include such as hydrogenated rosin, rosin, disproportionated rosin, polymerized rosin and rosin ester; rosin-modified resins such as rosin-modified phenol resin, rosin-modified maleic acid resin and rosin-modified xylene resin; terpene resins such as those obtained from polyterpene, terpenephenol or hydrogenated terpene, and terpene-phenol-formaldehyde resin; petroleum resins such as polymers obtained from $C_5$ aliphatic hydrocarbons, $C_5$ alicyclic hydrocarbons or derivatives thereof, and polymers obtained form $C_9$ aromatic hydrocarbons, $C_9$ alicyclic hydrocarbons or derivatives thereof; styrene resins such as homopolymer or copolymers of styrene, α-methylstyrene or vinyltoluene; dicyclopentadiene resin, and coumarone-indene resins; and further xylene resins, phenol resins, styrene-maleic anhydride resins and ketone resins. These resins can be used either alone or in combination.

Examples of the aforesaid thermoplastic resin include ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth) acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; further polyesters, polyamides, cellulose resins, natural rubber, styrene-butadiene copolymer, isoprene polymer and chloroprene polymer. These resins can be used either alone or in combination.

In the present invention, it is preferable that the color of a portion of a receptor paper where the filling ink layer 2 has been transferred is substantially the same as the color of the receptor paper because a print image is formed on the filling ink layer 2 transferred on the receptor paper. For this reason, it is preferable that the filling ink layer 2 is colorlessly transparent or has the same color as that of the receptor paper. The colorlessly transparent filling ink layer can be obtained by incorporating substantially no pigment into any one of the release layer 3, the bridging transfer layer 4 and the adhesive layer 5. The filling ink layer having the same color as that of a receptor paper can be usually obtained by incorporating a pigment into the bridging-transfer layer 4. Since generally receptor papers are white, a body pigment is usually incorporated into the bridging-transfer layer 4. Of course, when colored receptor papers are used, the bridging-transfer layer 4 may be colored in the same color as that of the receptor papers by incorporating thereinto carbon black, or other inorganic or oragnic pigments, and if necessary, dyes. However, it is not always necessary that the filling ink layer has the same color as that of the receptor paper, and the filling ink layer may be colored in a color different from that of the receptor paper.

When the bridging-transfer layer 4 has poor selective transferability when transferring, it is preferable to improve the selective transferability by incorporating a pigment, especially a body pigment thereinto.

When the bridging-transfer layer 4 is incorporated with a pigment, especially a body pigment, the content of the pigment in the bridging-transfer layer 4 is preferably from 2 to 10% by weight. When the content of the pigment is smaller than the above range, the selective transferability is prone not to be sufficiently improved and the coloring is prone to be insufficeint. When the content of the pigment is larger than the above range, the transferability is prone to be degraded.

Examples of the aforesaid body pigment are silica powder, calcium carbonate, precipitated barium sulfate, magnesium carbonate and alumina. These body pigments can be used either alone or in combination.

The bridging-transfer layer 4 can be usually formed by use of a solvent type coating liquid. The coating amount of the bridging-transfer layer 4 is preferably from 3 to 9 g/m$^2$. When the coating amount is smaller than the above range, the bridging-transfer property of the filling ink layer 2 is prone to be degraded. When the coating amount is greater than the above range, the transferability of the filling ink layer 2 is prone to be degraded because the heat energy generated from heat generating dots of a usual thermal head is insufficient to transfer such a thick layer.

The adhesive layer 5 is basically the same in quality as the release layer. That is, the adhesive layer 5 is a heat-meltable layer composed of a wax as a major component and preferably has a melting temperature of 50° to 90° C. and a melt viscosity of 5 to 100 cps at 100° C. from the viewpoint of adhesion performance.

Examples of the wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes can be used either alone or in combination.

The adhesive layer may contain a small amount of, for example, 5 to 20% by weight of a resin for enhancing adhesion to the bridging-transfer layer. Examples of the resin are thermoplastic resins (including elastomers) including ethylene copolymers such as ethylene-vinyl acetate copolymer, ethylene-vinyl butyrate copolymer, ethylene (meth)-acrylic acid copolymer, ethylene-alkyl (meth) acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, cellulose resins, natural rubber, styrene-butadiene copolymer, isoprene polymer and chloroprene polymer; and tackifier resins including petroleum resins, rosin resins and terpene resins. These resins can be used either alone or in combination.

The adhesive layer 5 may be formed by use of a coating liquid in any form of hot-melt type, solvent type and emulsion type. The coating amount of the adhesive layer is preferably from 0.3 to 2 g/m$^2$. An adhesive layer with a coating amount of smaller than the above range does not exhibit a sufficient adhesion. An adhesive layer with a coating amount of larger than the above range unfavorably requires a large amount of heat energy for transferring.

In the thermal transfer recording medium of the present invention, usually, a colored ink layer or plural colored ink layers different in color with each other are provided on the same foundation together with the filling ink layer.

Figure 3:
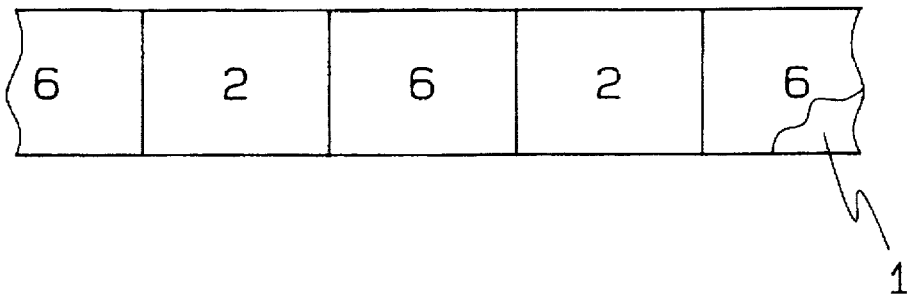
FIG. 3 is a partial plan view showing an example of the arrangement of the filling ink layer and the colored ink layer in the thermal transfer recording medium of the present invention.
Figure 4:
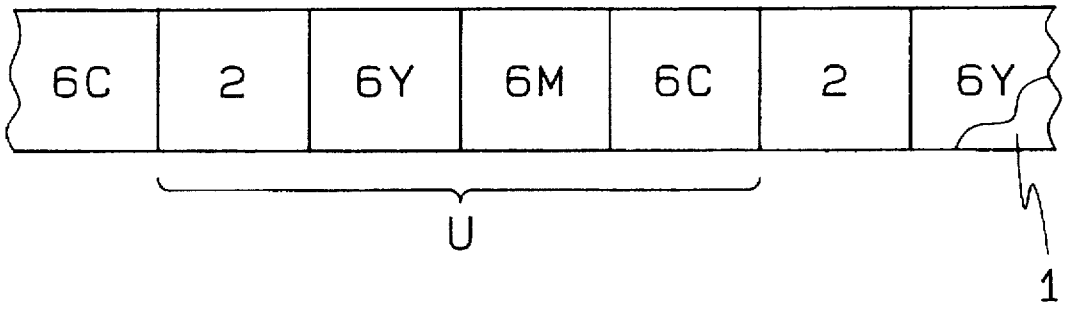
FIG. 4 is a partial plan view showing another example of the arrangement of the filling ink layer and the colored ink layer in the thermal transfer recording meidum of the present invention.
Figure 5:
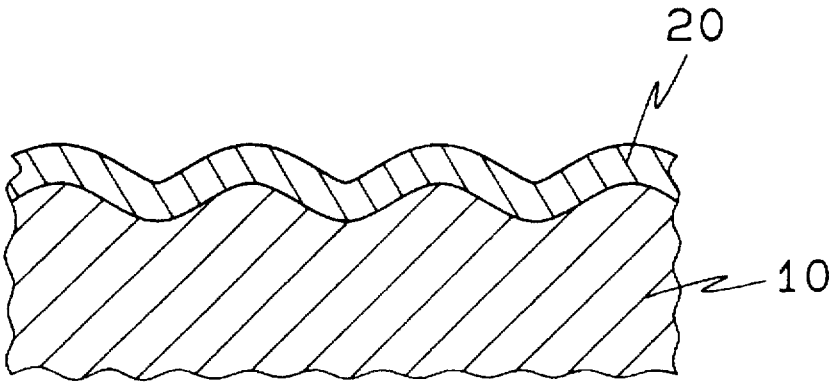
FIG. 5 is a schematic partial sectional view showing a condition where a conventional filling layer is transferred on a receptor.

FIG. 3 is a partial plan view showing an example of the arrangement of the filling ink layer and one type of a colored ink layer. FIG. 4 is a partial plan view showing an example of the arragement of the filling ink layer and plural types of colored ink layers.

The thermal transfer recording medium of the embodiment illustrated in FIG. 3 is usually used for forming a monochromatic image. In FIG. 3, a filling ink layer 2 and a colored ink layer 6, each of which preferably has a give constant size, are alternately repeatedly arranged in a side-by-side relation on a foundation 1. The colored ink layer 6 is an ink layer colored in a color such as black, red, blue, green, yellow, magenta or cyan.

The formation of a print image with use of the thermal transfer recording medium illustrated in FIG. 3 is performed as follows: With use of a dot-type thermal transfer printer, one of the filling ink layers 2 on the recording medium is superimposed on a receptor paper and the filling ink layer 2 is transferred onto the receptor paper by solid printing so as to cover at least a portion where the colored ink layer is transferred later. The colored ink layer 6 adjacent to the previously used filling ink layer 2 is superimposed on the filling ink layer transferred on the receptor paper and transferred imagewise to give a print image. Then, the filling ink layer 2 adjacent to the previously used colored ink layer 6 is superimposed on another receptor paper, followed by the same procedures as above to give another print image.

The thermal transfer recording medium of the embodiment illustrated in FIG. 4 is used for forming a polychromatic or full-color image utilizing subtractive color mixture. In FIG. 4, a filling ink layer 2, a yellow ink layer 6Y, a magenta ink layer 6M and a cyan ink layer 6C, each of which preferably has a given constant size, are repeatedly arranged in a side-by-side relation on a foundation 1 in a repeating unit U wherein the filling ink layer 2 and the colored ink layers 6Y, 6M and 6C are arranged in a predetermined order.

The order of arrangement of the three colored ink layers 6Y, 6M and 6C in the repeating unit U can be arbitrarily determined in consideration of the order of superimposition of respective colors and other factors. The repeating unit U may further includes a black ink layer.

The formation of a print image using the thermal transfer recording medium illustrated in FIG. 4 are performed as follows: With use of a dot-type thermal transfer printer, the filling ink layer 2 included in one of the repeated units U is superimposed on a receptor paper and transferred thereonto by solid printing so as to cover at least a portion where the ink layers 6Y, 6M and 6C are transferred later. The yellow ink layer 6Y included in the same repeating unit U is superimposed on the filling ink layer transferred on the receptor paper and transferred imagewise to give a yellow separation image. The magenta ink layer 6M and the cyan ink layer 6C included in the same repeating unit U are successively transferred imagewise in the same manner as above to give a magenta separation image and a cyan separation image, resulting in the yellow, magenta and cyan separation images superimposed one over the other on the filling ink layer. Thus a full-color image is formed. Then, with use of the repeating unit U adjacent to the previously used repeating unit U, a full-color image is formed on another receptor paper in the same manner as above. In some cases, only two of the yellow, magenta and cyan ink layers included in one repeating unit U are used for forming a color image.

The aforesaid color image formation manner gives a color image comprising (A) at least one color region wherein a color is developed by virtue of subtractive color mixture of at least two superimposed inks of yellow, magenta and cyan, or a color image comprising a combination of (A) at least one color region wherein a color is developed by virtue of subtractive color mixture of at least two superimposed inks of yellow, magenta and cyan and (B) at least one region of single color selected from yellow, magenta and cyan wherein different color inks are not superimposed. Herein a region where the yellow ink and the magenta ink are present in a superimposed state develops a red color; a region where the yellow ink and the cyan ink are present in a superimposed state develops a green color; a region where the magenta ink and the cyan ink are present in a superimposed state develops a blue color; and a region where the yellow ink, the magenta ink and the cyan ink are present in a superimposed state develops a black color. A region where only the yellow ink, the magenta ink or the cyan ink is present in a non-superimposed state develops a yellow color, a magenta color or a cyan color.

In the above manner, a black color is obtained by the superimposing of the yellow ink, the magenta ink and the cyan ink. However, a black color may be obtained by using only the black ink instead of using the three color inks.

The aforesaid colored ink layer 6, 6Y, 6M and 6C are each composed of a heat-meltable vehicle and a coloring agent. The heat-meltable vehicle is composed of a wax and/or a resin.

Examples of the wax include natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes can be used either alone or in combination.

Examples of the resin are thermoplastic resins (including elastomers) including ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethylene-acrylonitrile copolymer, ethylene-acrylamide copolymer, ethylene-N-methylolacrylamide copolymer and ethylene-styrene copolymer; poly(meth)acrylic acid esters such as polylauryl methacrylate and polyhexyl acrylate; vinyl chloride polymer and copolymers such as polyvinyl chloride, vinyl chloride-vinyl acetate copolymer and vinyl chloride-vinyl alcohol copolymer; polyesters, polyamides, cellulose resins, natural rubber, styrene-butadiene copolymer, isoprene polymer and chloroprene polymer; and tackifier resins including petroleum resins, rosin resins and terpene resins. These resins can be used either alone or in combination.

Usable as the coloring agent for the colored ink layer 6 are carbon black as well as various organic or inorganic pigments, and dyes.

Usable as the coloring agents for yellow, magenta and cyan for the colored ink layers 6Y, 6M and 6C are preferably transparent ones.

Examples of the transparent coloring agent for yellow include organic pigments such as Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake; and dyes such as Auramine. These coloring agents may be used either alone or in combination.

Examples of the transparent coloring agent for magenta include organic pigments such as Permanent Red 4R, Brilliant Fast Scarlet, Brilliant Carmine BS, Permanent Carmine FB, Lithol Red, Permanent Red F5R, Brilliant Carmine 6B, Pigment Scarlet 3B, Rhodamine Lake B, Rhodamine Lake Y and Arizalin Lake; and dyes such as Rhodamine. These coloring agents may be used either alone or in combination.

Examples of the transparent coloring agent for cyan include organic pigments such as Victoria Blue Lake, metal-free Phthalocyanine Blue, Phthalocyanine Blue and Fast Sky Blue; and dyes such as such as Victoria Blue. These coloring agents may be used either alone or in combination.

The term "transparent pigment" is herein meant by a pigment which gives a transparent ink when dispersed in a transparent vehicle.

If the subtractive color mixture utilizing superimposing of the three colors, yellow, magenta and cyan, can hardly give a clear black color, there may be further used a black ink layer containing a coloring agent for black such as carbon black, Nigrosine Base or the like. The black ink layer for this purpose is not adapted for the superimposing with other color ink layer and, hence, need not be necessarily transparent. Nevertheless, the black ink layer is preferably transparent for the purpose of giving a desired color such as blue black by the superimposing with other color ink layer.

The content of the coloring agent in each of colored ink layers is preferably about 5 to about 60% by weight.

Each of the colored ink layers may be incorporated, in addition to the above ingredients, with a dispersant, an antistatic agent and other additives, as required.

Each of the colored ink layers for respective colors preferably has a melting or softening point of 60° to 100° C. and a coating mount of 0.5 to 4.0 g/m$^2$.

Usable as the foundation for the thermal transfer recording medium of the present invention are polyester films such as polyethylene terephthalate film, polyethylene naphthalate film and polyarylate film, polycarbonate films, polyamide films, aramid films and other various plastic films commonly used for the foundation of ink ribbons of this type. Thin paper sheets of high density such as condenser paper can also be used.

On the back side (the side adapted to come into slide contact with a thermal head) of the foundation may be formed a conventionally known stick-preventive layer. Examples of the materials for the stick-preventive layer include various heat-resistant resins such as silicone resin, fluorine-containing resin and nitrocellulose resin, and other resins modified with these heat-resistant resins such as silicone-modified urethane resins and silicone-modified acrylic resins, and mixtures of the foregoing heat-resistant resins and lubricating agents.

The thickness of the foundation is usually from about 1 to about 10 μm.

According to another aspect of the present invention, the thermal transfer recording medium may be that wherein only a filling ink layer 2 is provided on a foundation 1 (hereinafter referred to as "recording medium A").

The recording medium A can be used in combination with a thermal transfer recording medium wherein only a colored ink layer is provided on a foundation (hereinafter referred to as "recording medium B"). In that case, first the filling ink layer is transferred onto a receptor paper with use of the recording medium A and the colored ink layer is then transferred imagewise to give an image with use of the recording medium B.

Further, the recording medium A can be used in combination with a thermal transfer recording medium wherein a yellow ink layer, a magenta ink layer and cyan ink layer, and optionally a black ink layer are provided on a single foundation, or an assembly of a thermal transfer recording medium wherein a yellow ink layer is provided on a foundation, a thermal transfer recording medium wherein a magenta ink layer is provided on a foundation and a thermal transfer recording medium wherein a cyan ink layer is provided on a foundation, and optionally a thermal transfer recording medium wherein a black ink layer is provided on a foundation, thereby giving a polychromatic image or a full-color image.

As the aforesaid thermal transfer recording media used in combination with the recording medium A, usable are any of conventional ones.

The present invention will be more fully described by way of Examples. It is to be understood that the present invention is not limited to the Examples, and various change and modifications may be made in the invention without departing from the spirit and scope thereof.

EXAMPLES 1 TO 3

Onto the front side of a 6 μm-thick polyethylene terephthalate film which was provided on the back side thereof with a heat-resistant stick-preventive layer were applied the colored inks for respective colors each having the formula shown in Table 1 by hot-melt coating to form the colored ink layers for respective colors which were arranged as shown in FIG. 4.

The ink having the formula shown in Table 2 was applied onto the respective exposed surfaces of the film between the cyan ink layer and the yellow ink layer by hot-melt coating to form a release layer having the coating amount shown in Table 4. The ink liquid having the formula shown in Table 3 was applied onto the release layer and dried to form a bridging-transfer layer having the coating amount shown in Table 4. Then the ink having the formula shown in Table 2 was applied onto the bridging-transfer layer by hot-melt coating to form an adhesive layer having the coating amount shown in Table 4, thus yielding a filling ink layer having a three-layer structure.

TABLE 1

| | Yellow ink | Magenta ink | Cyan ink |
|---|---|---|---|
| Formula (parts by weight) | | | |
| Paraffin wax | 60 | 60 | 60 |
| Carnauba wax | 20 | 20 | 20 |
| Ethylene-vinyl acetate copolymer | 5 | 5 | 5 |
| Pigment Yellow | 15 | — | — |
| Carmine 6B | — | 15 | — |
| Cyanine Blue KRO | — | — | 15 |
| Coating amount (g/m$^2$) | 2.0 | 2.0 | 2.0 |
| Melting point (°C.) | 72 | 72 | 72 |

TABLE 2

Release layer or adhesive layer
(m.p. 72° C., melt viscosity 60 cps at 100° C.)

| Components | Parts by weight |
|---|---|
| Paraffin wax 155° F. | 80 |
| Microcrystalline wax | 20 |

TABLE 3

| Bridging-transfer layer (softening point 69° C., melt viscosity 350 cps at 100° C.) | |
|---|---|
| Components | Parts by weight |
| Petroleum resin | 34 |
| Ethylene-vinyl acetate copolymer | 14 |
| Silica powder | 2 |
| Toluene | 50 |

TABLE 4

| Filling ink layer | Ex. 1 | Ex. 2 | Ex. 3 |
|---|---|---|---|
| Coating amount (g/m²) | | | |
| Adhesive layer | 1.0 | 1.25 | 1.5 |
| Bridging-transfer layer | 3.0 | 5.0 | 7.0 |
| Release layer | 1.0 | 1.25 | 1.5 |
| Total | 5.0 | 7.5 | 10.0 |

COMPARATIVE EXAMPLES 1 TO 4

The same procedures as in Examples 1 to 3 except that a filling ink layer having a single-layer structure was used instead of the filling ink layer having three-layer structure were repeated to form a thermal transfer recording medium.

The filling ink layer having a single-layer structure (m.p. 73° C., melt viscosity 100 cps at 100° C.) with the coating amount shown in Table 5 was formed by applying the ink having the formula shown in Table 5 by means of hot-melt coating.

TABLE 5

| | Com. Ex. 1 | Com. Ex. 2 | Com. Ex. 3 | Com. Ex. 4 |
|---|---|---|---|---|
| Formula (parts by weight) | | | | |
| Paraffin wax 155° F. | 54 | 54 | 54 | 54 |
| Ethylene-vinyl acetate copolymer | 16 | 16 | 16 | 16 |
| Microcrystalline wax | 20 | 20 | 20 | 20 |
| Coating amount (g/m²) | 5.0 | 7.5 | 10 | 14 |

Each of the thus obtained thermal transfer recording media was evalulated for the following properties. The results are shown in Table 6.

(1) Rough paper adaptability

With use of a thermal transfer color printer (JX-570 made by Sharp Corporation), the filling ink layer was transferred onto a receptor paper (XEROX 4024, Bekk smoothness: 30 seconds) by solid printing at a standard printing energy prescribed with the printer, and then the yellow ink layer, the magenta ink layer and the cyan ink layer were superimposingly transferred onto the filling ink layer in succession in that order by solid printing under the same conditions as above to give a printed matter. Void level was observed by the naked eye.

4: No voids were observed.

3: A very small number of voids were observed.

2: A small number of voids were observed.

1: A large number of voids were observed.

(2) Transfer sensitivity of filling ink layer

With use of the aforesaid printer, the filling ink layer was transferred onto the aforesaid receptor paper by solid printing at the minimum printing energy prescribed with the printer. The degree of the transfer of the filling ink layer in the printed portion was observed by the naked eye.

4: The filling ink layer was completely transferred.

3: A trace mount of the filling ink layer remained on the foundation.

2: A small mount of the filling ink layer remained on the foundation.

1: A considerable mount of the filling ink layer remained on the foundation.

TABLE 6

| | Total coating amount of filling ink layer (g/m²) | Evaluation: Rough paper adaptability | Evaluation: Transfer sensitivity of filling ink layer |
|---|---|---|---|
| Ex. 1 | 5.0 | 3 | 4 |
| Ex. 2 | 7.5 | 4 | 3 |
| Ex. 3 | 10 | 4 | 3 |
| Com. Ex. 1 | 5.0 | 1 | 4 |
| Com. Ex. 2 | 7.5 | 2 | 3 |
| Com. Ex. 3 | 10 | 2 | 2 |
| Com. Ex. 4 | 14 | 2 | 1 |

As is apparent from the results shown in Table 6, print images of high quality can be formed on a receptor paper having a rough surface by transferring the filling ink layer having the three-layer structure according to the present invention onto the receptor paper and then forming a print image thereon.

As described above, by use of the thermal transfer recording medium of the present invention, the surface of a receptor paper that is significantly uneven can be changed to a flat one by a single thermal transfer operation, and print images of high quality can be formed by transferring a colored ink layer onto the flat surface.

In addition to the materials and ingredients used in the Examples, other materials and ingredients can be used in Examples as set forth in the specification to obtain substantially the same results.

What is claimed is:

1. A thermal transfer recording medium comprising a foundation, and a filling transfer layer provided on the foundation, the filling transfer layer being thermally transferred onto a receptor in advance of formation of a print image thereon, the filling transfer layer being colorlessly transparent and comprising a release layer containing a wax as the major component on a weight basis, a transfer layer comprising a tackifier resin as a main ingredient and having a high melt viscosity and an adhesive layer containing a wax as the major component on a weight basis, the three layers being stacked in this order on the foundation.

2. The thermal transfer recording medium of claim 1, wherein the transfer layer comprising a tackifier resin as a main ingredient and having a high melt viscosity comprises 40 to 80% by weight of a tackifier resin, and 15 to 40% by weight of a thermoplastic resin.

3. The thermal transfer recording medium of claim 1, wherein the release layer has a melt viscosity of 5 to 100 cps at 100° C., the transfer layer comprising a tackifier resin as a main ingredient and having a high melt viscosity has a melt viscosity of 150 to 10,000 cps at 100° C., and the adhesive layer has a melt viscosity of 5 to 100 cps at 100° C.

4. A thermal transfer recording medium comprising a foundation, a filling transfer layer provided on the foundation, a colored ink layer provided directly on the foundation in addition to the filling transfer layer, the colored ink layer comprising a heat-meltable vehicle and a coloring agent, the filling transfer layer being thermally transferred onto a receptor in advance of formation of a print image thereon, the filling transfer layer comprising a release layer containing a wax as the major component on a weight basis, a transfer layer comprising a tackifier resin as a main ingredient and having a high melt viscosity and an adhesive layer containing a wax as the major component on a weight basis, the three layers being stacked in this order on the foundation.

5. The thermal transfer recording medium of claim 4, wherein the colored ink layer comprises a yellow ink layer, a magenta ink layer and a cyan ink layer.

6. The thermal transfer recording medium of claim 4, wherein the transfer layer comprising a tackifier resin as a main ingredient and having a high melt viscosity comprises 40 to 80% by weight of a tackifier resin, 15 to 40% by weight of a thermoplastic resin, and 0 to 10% by weight of a pigment.

7. The thermal transfer recording medium of claim 4, wherein the release layer has a melt viscosity of 5 to 100 cps at 100° C., the transfer layer comprising a tackifier resin as a main ingredient and having a high melt viscosity has a melt viscosity of 150 to 10,000 cps at 100° C., and the adhesive layer has a melt viscosity of 5 to 100 cps at 100° C.

* * * * *

UNITED STATES PATENT AND TRADEMARK OFFICE

CERTIFICATE OF CORRECTION

PATENT NO. : 5,700,584

DATED : December 23, 1997

INVENTOR(S) : Hideki Suematsu

It is certified that error appears in the above-identified patent and that said Letters Patent is hereby corrected as shown below:

Cover page, item [56] delete "A-62-48591" and substitute therefor -- A-61-51387 -- and delete "A-61-51387" and substitute therefore -- A-62-48591 --.

Column 1, lines 41, 43, and 45; column 2, line 1; column 9, line 31; and column 12, lines 3, 5, and 7 delete "mount" and substitute therefor -- amount --.

Column 2, line 63 delete "meidum" and substitute therefor -- medium --.

Column 3, line 12 delete "i." and substitute therefor -- 1. --.

Column 4, line 51 after "include" insert -- rosins --.

Column 4, line 52 delete second occurrence of "rosin,".

Column 5, line 37 delete "oragnic" and substitute therefor -- organic --.

UNITED STATES PATENT AND TRADEMARK OFFICE

CERTIFICATE OF CORRECTION

PATENT NO. : 5,700,584

DATED : December 23, 1997

INVENTOR(S) : Hideki Suematsu

It is certified that error appears in the above-identified patent and that said Letters Patent is hereby corrected as shown below:

Column 5, line 52 delete "insufficeint." and substitute therefor -- insufficient. --.

Column 6, line 37 delete "polyvinyI" and substitute therefor -- polyvinyl --.

Column 6, line 60 delete "arragement" and substitute therefor -- arrangement --.

Signed and Sealed this

Tenth Day of October, 2000

*Attest:*

*Attesting Officer*

Q. TODD DICKINSON

*Director of Patents and Trademarks*